US005545115A

United States Patent [19]

Corcoran

[11] Patent Number: 5,545,115

[45] Date of Patent: Aug. 13, 1996

[54] SNOWBOARD SIMULATOR APPARATUS

[76] Inventor: Andrew E. Corcoran, 55 Ruggles Ave., Newport, R.I. 02840

[21] Appl. No.: 422,243

[22] Filed: Apr. 14, 1995

[51] Int. Cl.[6] ..... A63G 3/00

[52] U.S. Cl. ..... 482/146; 482/34

[58] Field of Search ..... 280/87.041, 87.042; 482/146, 147, 79, 80; 472/13, 114, 110, 128, 135

[56] References Cited

U.S. PATENT DOCUMENTS

| | | | |
|---|---|---|---|
| 2,764,411 | 9/1956 | Washburn, Jr. | 482/146 |
| 2,950,120 | 8/1960 | Stewart | 482/146 |
| 3,488,049 | 1/1970 | Sasser | 482/146 |
| 4,505,477 | 3/1985 | Wilkinson | 482/146 |
| 4,787,630 | 11/1988 | Watson et al. . | |
| 5,152,691 | 10/1992 | Moscarello . | |
| 5,190,506 | 3/1993 | Zubik et al. . | |
| 5,192,258 | 3/1993 | Keller . | |

*Primary Examiner*—Jerome Donnelly
*Attorney, Agent, or Firm*—Barlow & Barlow, Ltd.

[57] ABSTRACT

An apparatus which closely simulates actual snowboarding is provided. The snowboard simulator apparatus includes a board member with a curved or convex lower surface, a pair of stop members positioned on the longitudinal edges of the board, a pair of cross-rails positioned perpendicularly relative to the stop members and a roller member having a pair of guide slots for engaging with the cross-rails. The rolling travel of the roller member is limited by the stop members while the positioning of the roller member on the lower surface of the board member is controlled by the engagement of the cross-rails with guide slots. The apparatus generates a front-to-back action for the user which closely simulates actual snowboarding. The apparatus is also capable of simulating a pivot turn maneuver as experienced in real snowboarding.

1 Claim, 6 Drawing Sheets

SNOWBOARD SIMULATOR APPARATUS

BACKGROUND OF THE INVENTION

The present invention relates generally to a balancing board apparatus. More specifically, the present invention relates to a snowboard simulator balancing board apparatus for closely simulating the act of snowboarding on dry land.

In the field of balancing boards, it has been well known to employ a board member or platform with a roller member thereunder. The user of the apparatus stands on the platform, with feet apart, with the roller member positioned between the platform and the ground. The platform is often elongated and in a rectangular shape with rounded ends. In these prior art apparatuses, the roller is placed underneath the board so that it's central axis is perpendicular to the longitudinal length of the board. In operation, the user places the platform on the roller and then stands on the platform with his or her feet being in a line which is substantially parallel to the longitudinal length of the platform. The roller is then positioned below the platform with its central axis perpendicular to the line between the user's feet. As a result, the roller is positioned substantially between the user's feet. To use the balancing board, the user rocks his or her body left to right to rock side-to-side on the roller in a see-saw-type fashion.

For example, U.S. Pat. No. 5,190,506, issued to Zubik et al., incorporated herein by reference, discloses a balancing board having a longitudinal deck which engages a roller assembly to achieve a rocking see-saw action. In addition, U.S. Pat. No. 4,505,477, incorporated herein by reference, discloses a balancing board having a platform to which a pair of parallel tracks are mounted to the lower surface. A set of wheels are mounted to a common shaft and are biased toward the center of the tracks by springs. The set of wheels roll freely along the length of the platform to permit the balancing board to achieve a rocking side-to-side motion. Also, U.S. Pat. No. 5,152,691, incorporated herein by reference, discloses a snowboard simulator balance apparatus with a board and cylindrical roller. The board includes a ridge for engaging with a notch in the roller to center the roller and guide it back and forth along the length of the board.

The prior art balancing boards have made attempts to improve the tracking and retention of a roller along its travel over the length of a balancing board. Various apparatuses have been attempted to achieve an improved fluid roll of a platform on a roller to further enhance performance. In addition, attempts have been made to ensure that the roller remains centered along the length of the board. However, each of these apparatuses in the prior art disclose and further enhance the experience of a rocking side-to-side see-saw motion which is distinctly different than the motion actually experienced during snowboarding on real snow. In particular, prior art balancing board apparatuses fail to closely simulate the experience and motion of real snowboarding.

Due to the demand for a snowboard simulator which can closely simulate snowboarding on real snow, it is desirable for a simulator apparatus to mimic and simulate the actual movement and experience of real snowboarding. It is also desirable to have a snowboard simulator apparatus which can simulate as many different types of maneuvers and tricks which can be executed on a real snowboard on actual snow.

SUMMARY OF THE INVENTION

The present invention preserves the advantages of prior art balancing board and snowboard simulator apparatuses. In addition, it provides new advantages not found in currently available apparatuses, and overcomes many disadvantages of such currently available apparatuses.

The invention is generally directed to a novel and unique snowboard simulator apparatus with particular application in permitting the user to execute moves which are only capable on an actual snowboard on real snow. The snowboard simulator apparatus of the present invention enables the user to simulate the experience of snowboarding on dry land.

The preferred embodiment of the present invention includes four primary members. An elongate board member is provided having an upper surface, a lower surface and two longitudinal edges. The board member has a length which is substantially greater than its width. A user is capable of standing on the upper surface of the board member. A pair of stop members are located on the lower surface of the board member and are positioned proximal to and running along the longitudinal edges, respectively. The stop members are positioned substantially parallel to one another. A pair of cross-rails are located on the lower surface of the board member and are positioned between and perpendicular to the stop members. In addition, a cylindrical roller is positioned on the lower surface of the board member and positioned relative to the board member so the cylindrical roller's central axis is positioned parallel to the length of the board member. The cylindrical roller preferably includes a pair of spaced apart guide slots which are engageable with the cross-rails.

In operation, a user stands on the upper surface of the board member with the roller positioned between the lower surface and the ground. In particular, the user's feet are positioned on the elongate board member in the typical position used for operating a snowboard, i.e. the user's feet being spaced apart and aligned with the length of the board member. Due to the positioning of the cross-rails and the guide slots on the cylindrical roller which engage with the cross-rails, the cylindrical roller will be positioned so its central axis is parallel with the length of the board as well as being parallel with the line between the user's feet.

The user may exert downward forces in an array of different directions to create and simulate various snowboard movements. For example, the user may roll front to back to closely simulate forward downslope movement on an actual snowboard. Or, in the alternative, the user may focus the downward pressure on one of his or her feet to permit pivoting about a single point to simulate a turning action on an actual snowboard. Additional maneuvers will be discussed in more detail below.

It is therefore an object of the present invention to provide a snowboard simulator apparatus that can closely simulate an actual snowboard on real snow.

Another object of the present invention is to provide a snowboard simulator apparatus that can simulate the forward downslope movement of a snowboard on real snow.

It is a further object of the present invention to provide a snowboard simulator apparatus that can closely simulate the turning movement of an actual snowboard on real snow.

It is yet a further object of the present invention to provide a snowboard simulator apparatus which can closely simulate a true snowboard experience without the need for elaborate mechanical parts or machinery.

BRIEF DESCRIPTION OF THE DRAWINGS

The novel features which are characteristic of the present invention are set forth in the appended claims. However, the inventions preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
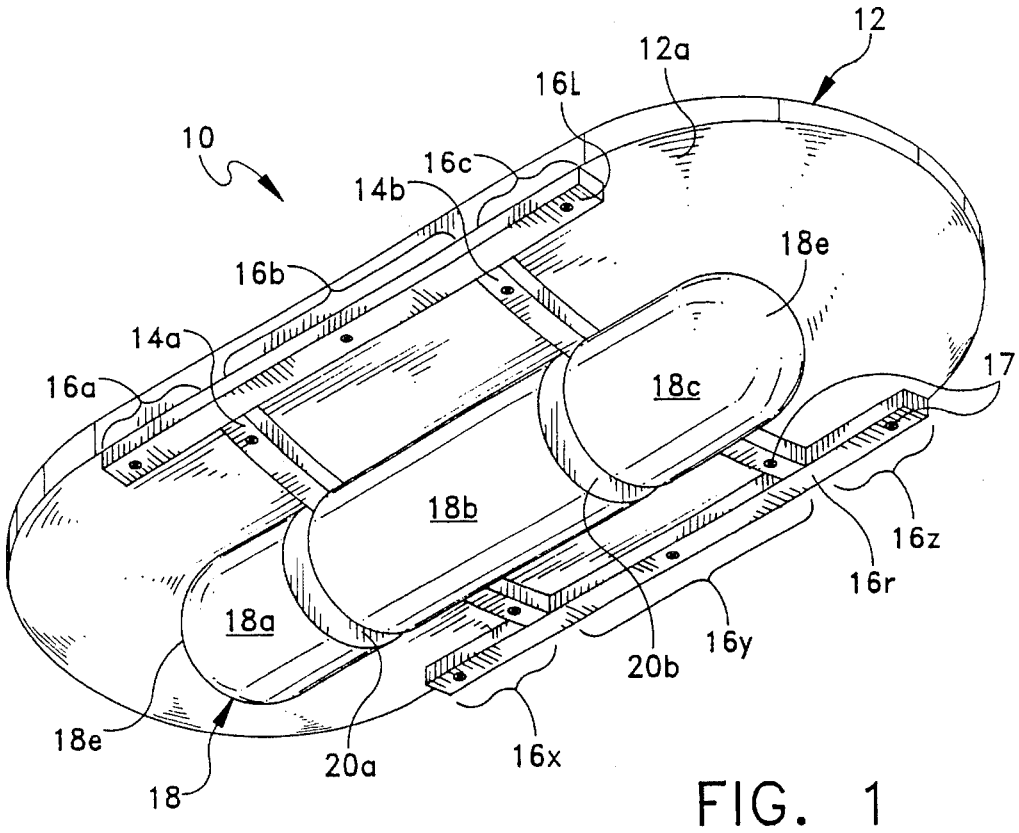
FIG. 1 is a perspective view from below of the preferred embodiment of the snowboard simulator apparatus of the present invention.

Referring to FIG. 1, a perspective view from below of the preferred embodiment of the snowboard simulator apparatus 10 of the present invention is shown. Board member 12, which is preferably made of wood, is provided with a pair of stops 16L and 16R positioned along the longitudinal edges of board member 12. It is preferred that board member 12 be of a configuration substantially similar to standard snowboards where the length of the board is substantially longer than the width of the board. As a result, the snowboard simulator 10 includes stops 16L and 16R running along the length of the board at its opposing edges. As can be seen in FIG. 1, stops 16L and 16R are affixed to the lower surface 12*a* of board member 12 which is preferably curved or convex in configuration.

Still referring to FIG. 1, cross-rails 14*a* and 14*b* are positioned on the lower surface 12*a* of board member 12 in a location perpendicular to stops 16L and 16R as well as spaced apart from one another. In particular, cross-rails 14*a* and 14*b* are spaced apart from one another and positioned relative to the stops 16L and 16R so as to divide the left stop member 16L into three portions: a first stop extension portion 16*a;* a central stop portion 16*b;* and a second stop extension portion 16*c*. Further, the positioning of cross-rails 14*a* and 14*b* divide right stop member 16R into three regions: first stop extension portion 16*x;* central stop portion 16*y;* and second stop extension portion 16*z*. The cross-rails 14*a* and 14*b* as well as stop members 16L and 16R contain and control the movement of cylindrical roller 18 on the lower surface 12*a* on board member 12.

Figure 2:
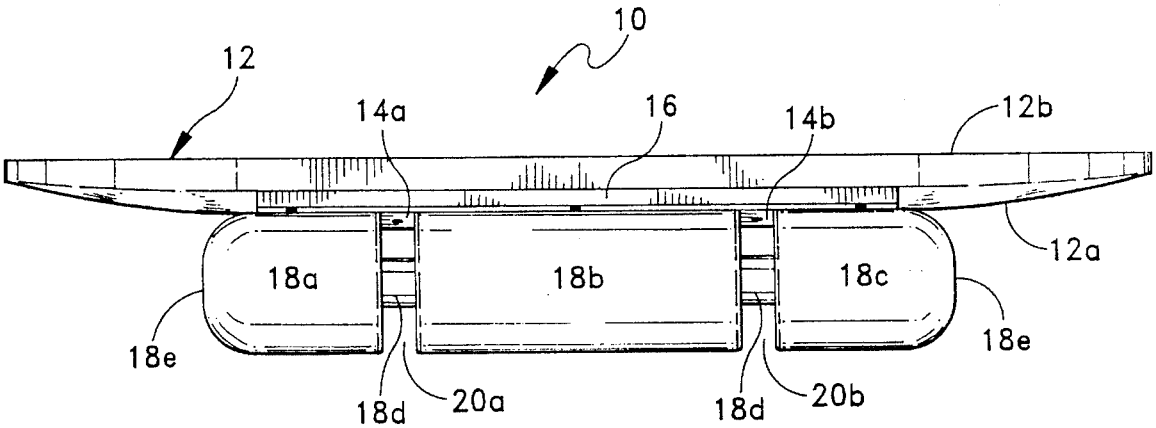
FIG. 2 is a front view of the apparatus of FIG. 1 according to the present invention.

Roller member 18 is preferably cylindrical and in configuration and manufactured of wood. However, other materials, such as plastic, may be employed for roller member 18. Referring to FIG. 1 and FIG. 2, roller member 18 includes three primary sections. Left portion 18*a*, central portion 18*b* and right portion 18*c* are provided. Members 18*d* connect the three portions of the roller member together. Ends 18*e* are preferably rounded and are helpful to the execution of certain snowboard maneuvers as will be discussed in detail below. As a result of the use of members 18*d*, guide slots 20*a* and 20*b* are provided in cylindrical roller 18 about its circumference. The structure of roller member 18 may be formed from a single piece of material and routed into the appropriate shape in the event wood was employed, for example. Alternatively, each of the portions 18*a*, 18*b*, 18*c* and 18*d* may be separate components and then subsequently assembled together. Further, another alternative may be the formation of roller member 18 into a single integral molded piece of plastic. It should also be understood that it is preferred that members 18*d* have a small enough diameter so as not to contact cross-rails 14*a* and 14*b* to ensure that cylindrical roller 18 makes contact with the lower surface 12*a* of board member 12. In the alternative members 18*d* may have a large enough diameter to ride directly on cross-rails 14*a* and 14*b*.

Figure 3:
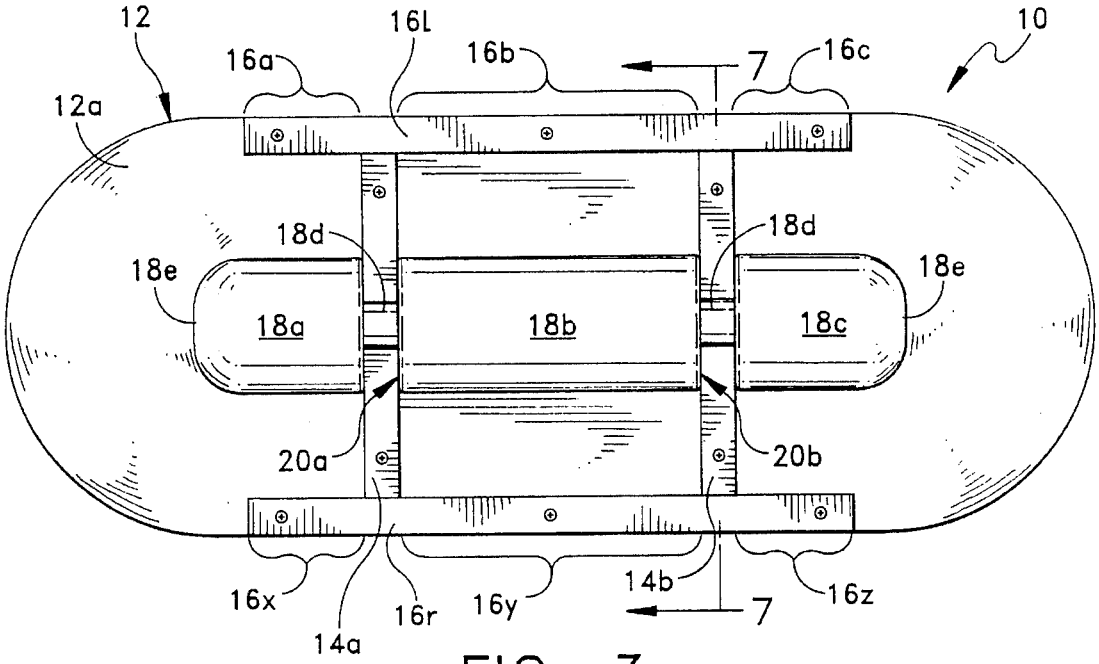
FIG. 3 is a bottom view of the apparatus of FIG. 1 according to the present invention.

Turning now to FIG. 3, the layout of component parts of the present invention are shown. As can be seen, stops 16L and 16R are positioned along the longitudinal edge of the lower surface 12*a* of board member 12. Cross-rails 14*a* and 14*b* essentially span the width of board member 12 between stop members 16L and 16R. In addition, cross-rails 14*a* and 14*b* are spaced apart from one another at a distance less than the length of each stop member 16L and 16R. As a result, stop members 16L and 16R and cross-rails 14*a* and 14*b* form a configuration resembling a roman numeral II. In addition, FIG. 3 illustrates the alignment of cross-rails 14*a* and 14*b* with guide slots 20*a* and 20*b* of roller member 18 to permit roller member 18 to roll on lower surface 12*a* in a controlled and directed fashion with its longitudinal axis being parallel with stop members 16L and 16R and the length of board member 12. As a result, roller member 18 may roll back and forth across the width of board member 12 while being bounded by stops 16L and 16R. In particular, the rolling travel of left portion 18*a* is specifically bounded by first stop extension portion 16*a* of stop member 16L and first stop extension portion 16*x* of stop member 16R. Central portion 18*b* of roller member 18 is specifically bounded by central stop portion 16*b* of stop member 16L and central stop portion 16*y* of stop member 16R. Similarly, right portion 18*c* of roller member 18 is bounded by second stop extension portion 16*c* of stop member 16L and second stop extension portion 16*z* of stop member 16R. As will be discussed in detail below, the employment of extension portions of stop members 16L and 16R enable the user to execute certain snowboard maneuvers without lower member 18 derailing from underneath board member 12.

Figure 4:
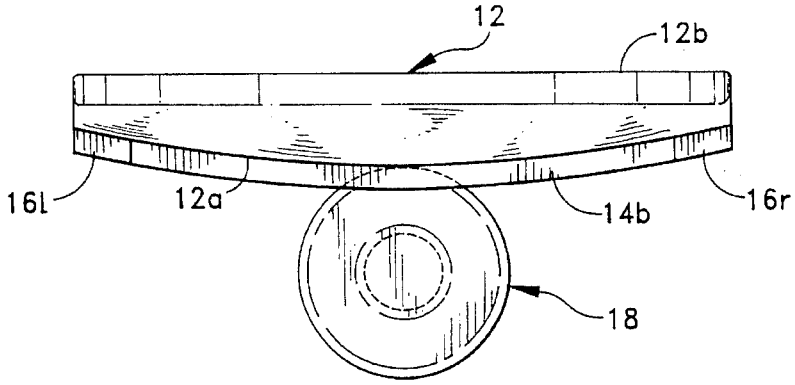
FIG. 4 is an end view of the apparatus of FIG. 1 according to the present invention.
Figure 5:
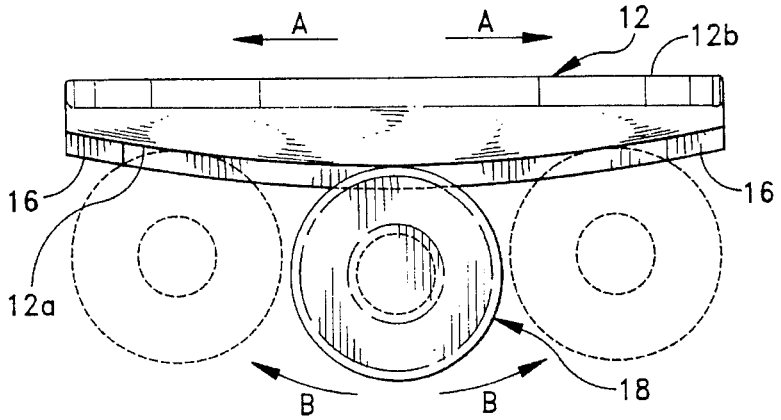
FIG. 5 is an end view of the apparatus of FIG. 1 according to the present invention illustrating the range of travel of the cylindrical roller.

FIG. 4 illustrates an end view of the present invention of FIG. 1 illustrating the positioning of roller member 18 on the lower surface 12*a* of board member 12. Roller member 18 rolls on lower surface 12*a* while being bounded by stop member 16L and 16R. FIG. 5 illustrates this range of travel of roller member 18. When a user stands on upper surface 12*b*, movement back and forth in the direction referenced "A" causes roller member 18 therebelow, in contact with lower surface 12*a*, to roll back and forth underneath board member 12 as indicated by arrows referenced B. The dotted representations of roller member 18 indicate the leftmost and rightmost travel of roller member 18 underneath board member 12. Further, as can be seen, the employment of a curved or convex lower surface 12*a* urges lower member 18 toward one of the dotted positions when the user exerts force on upper surface 12*b*. This enhances the challenge of the snowboard simulator of the present invention requiring the user to exert more effort to maintain balance.

Figure 6:
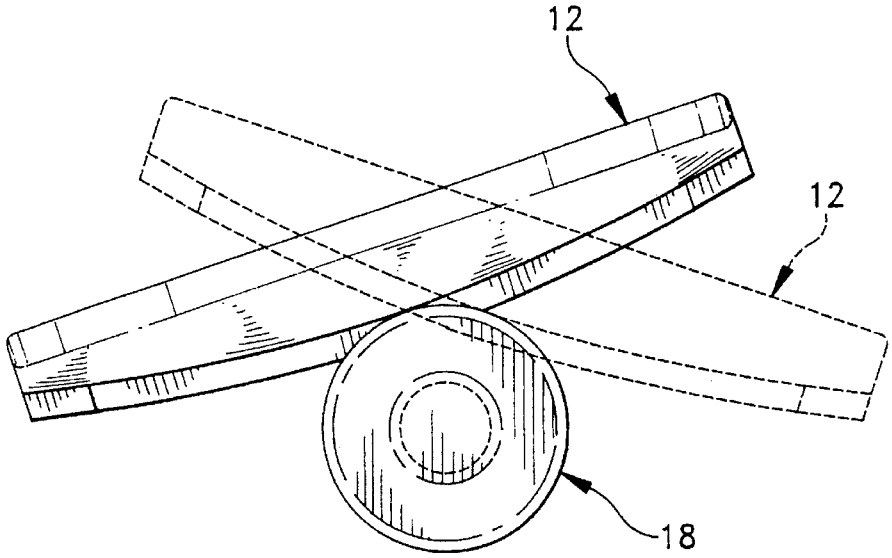
FIG. 6 is an end view of the present invention of FIG. 1 illustrating the ability of the board member to tilt on the cylindrical roller.
Figure 7:
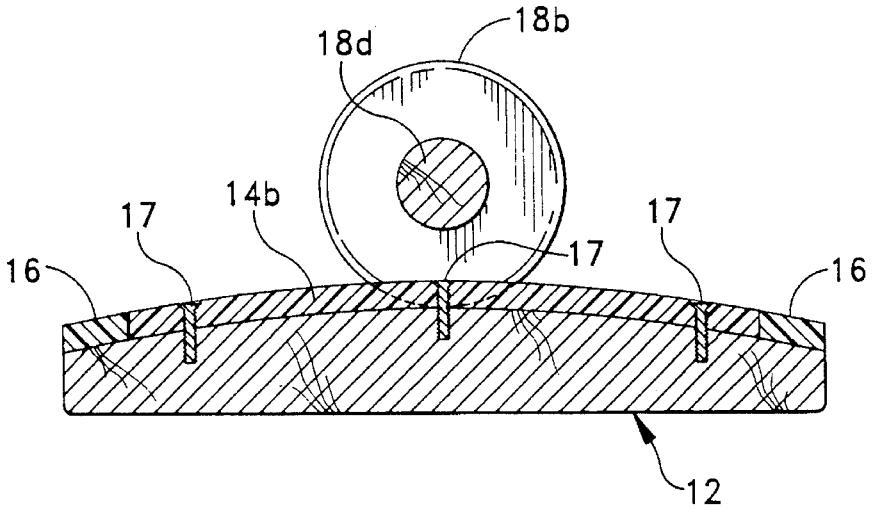
FIG. 7 is a cross sectional view through the lines 7—7 of FIG. 3.

FIG. 6 illustrates an end view of the snowboard simulator of the present invention where board member 12 is angled relative to the ground while roller member 18 is positioned generally in the middle of the width of the board 12. This tilting action can be achieved with the present invention, and as can be understood, can be maintained for only a fraction of a second before roller member 18 starts to travel toward one of the stop members 16L or 16R. FIG. 7 is a cross sectional view through the line 7—7 of FIG. 3 and illustrates the positioning of roller member 18 in contact with board member 12. Fasteners 17 are preferably employed to secure cross-rails 14*a* and 14*b*, as well as stop members 16L and 16R, to the lower surface 12*a* of board member 12. In the alternative, other methods may be employed to maintain cross-rails 14*a* and 14*b* as well as stop members 16L and 16R to board member 12, such as glue.

Referring back generally to FIGS. 1–7, in operation, a user stands on the upper surface 12*b* of board member 12 with roller member 18 positioned between the ground and lower surface 12*a*. Guide slots 20*a* and 20*b* are aligned with cross-rails 14*a* and 14*b*. The user exerts a downward force to cause roller member 18 to travel back and forth within the confines of stop member 16L and 16R across the width of board member 12 while being guided by cross-rails 14*a* and 14*b*. The direction of rolling or travel of roller member 18 is in a direction perpendicular to the length of the board and where the central axis of roller member 18 is parallel with the length of the board. In addition, the central axis of roller member remains substantially parallel with the line between each of the user's feet. As a result, the motion experienced by a user is a front-to-back action closely simulating actual snowboarding on real snow. In particular, this front-to-back movement closely simulates the action of real snowboarding while going straight downhill.

Figure 8:
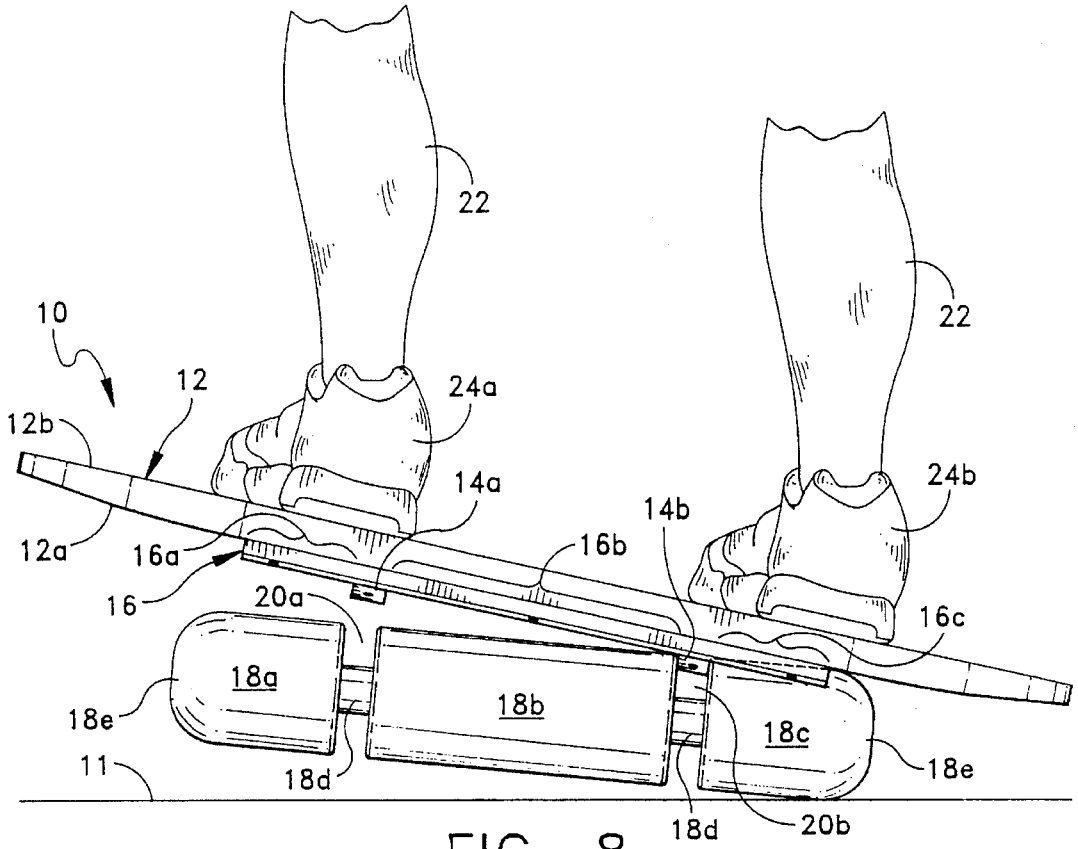
FIG. 8 is a front view of the present invention of FIG. 1 illustrating a user performing a pivot turning maneuver.

FIG. 8 illustrates the ability of the snowboard simulator 10 of the present invention to execute a turning maneuver experienced during actual snowboarding on real snow. The user's legs 22 are spaced apart from one another so that the user's left foot 24*a* is spaced apart from the user's right foot 24*b*. In a turning maneuver in actual snowboarding, the user shifts the exertion of force toward one side of the board underneath one of his or her feet to cause the opposing end of the board to elevate. The board is then pivoted about the point which is in contact with the snow to effect turning. Still referring to FIG. 8, a turning move, as experienced in real snowboarding, is shown where the pivot point is about the user's right foot 24*b*. In this example, the user shifts the downward force to underneath the right foot 24*b* causing the portion of the board under the left foot 24*a* to elevate off the ground 11. This permits the user to pivot on right portion 18*c* of roller member 18 to effectuate a simulated turn. End 18*e* of right portion 18*c* is preferably rounded to facilitate the pivoting at this point. When the weight is shifted to underneath right foot 24*b*, cross-rail 14*a* exits out of left guide slot 20*a* while right cross-rail 14*b* remains seated within right guide slot 20*b*. During this process, the only portion of roller member 18 remaining in contact with lower surface 12*a* is right portion 18*c* which is directly beneath right foot 24*b*. When the apparatus pivots, right portion 18*c* rolls in contact with lower surface 12*a*. Second stop extension portion 16*c* of stop 16L and second stop extension portion 16*z* of stop 16R (not seen in FIG. 8) serve to contain and limit the travel of right portion 18*c* therebetween. As a result, during a turning maneuver, lower member 18 remains controlled even though left portion 18*a* and central portion 18*b* are no longer in contact with lower surface 12*a*. Similarly, the same maneuver may be executed with force being shifted to the left foot 24*a* for pivoting about left portion 18*a* of roller member 18. The employment of two cross-rails 14*a* and 14*b* and guide slots 20*a* and 20*b* proximal to the two possible pivot points enables the snowboard simulator of the present invention to execute a simulated turn maneuver.

Figure 9:
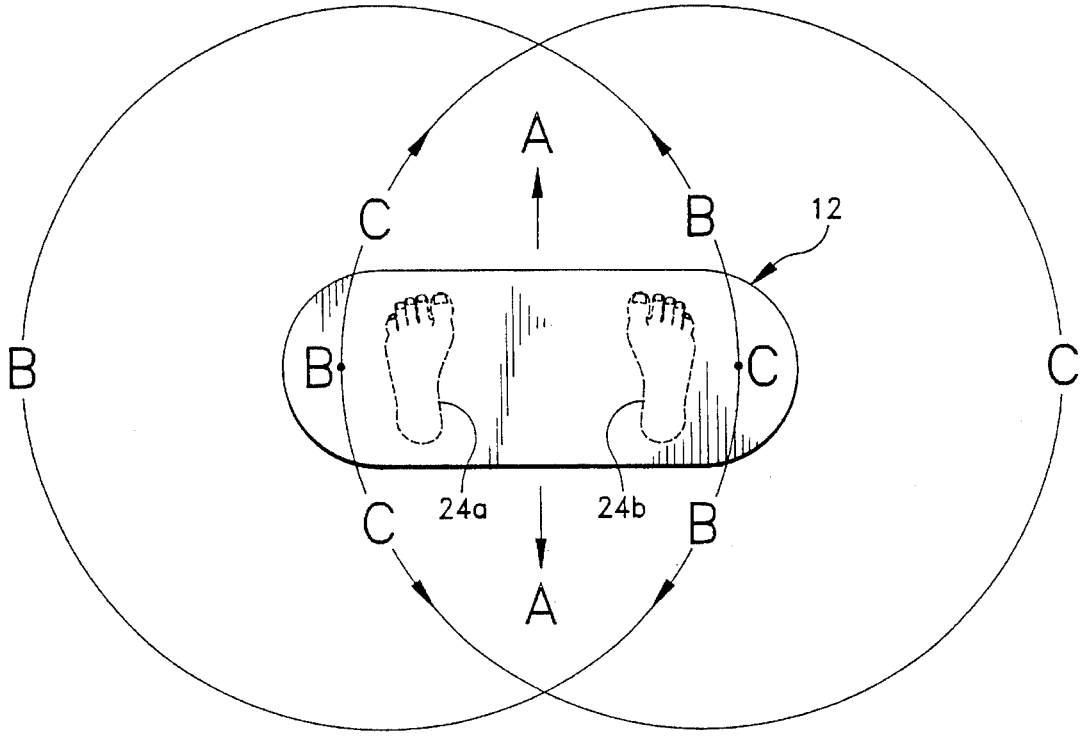
FIG. 9 is a top view of a user on a board member illustrating three of the possible maneuvers that can be executed in accordance with the present invention.

FIG. 9 is a top view of three possible movement patterns of the snowboard simulator of the present invention. Reference arrows "A" represent the front-to-back movement as illustrated in FIG. 5. Reference point "C" represents the pivot point about the user's right foot 24*b*. The path labeled "C" represents the pivot path of the snowboard simulator executing a turn maneuver pivoting about the right foot 24*b*. Similarly, pivot point "B" and the path labeled "B" represents the pivot path achieved through a turning maneuver about the user's left foot 24*a*. The foregoing paths discussed in connection with FIG. 9 are the three primary paths that can be achieved with the present invention. Other various maneuvers and paths can also be executed such as a pivot about a point equidistant between the user's feet 24*a* and 24*b*.

Figure 10:
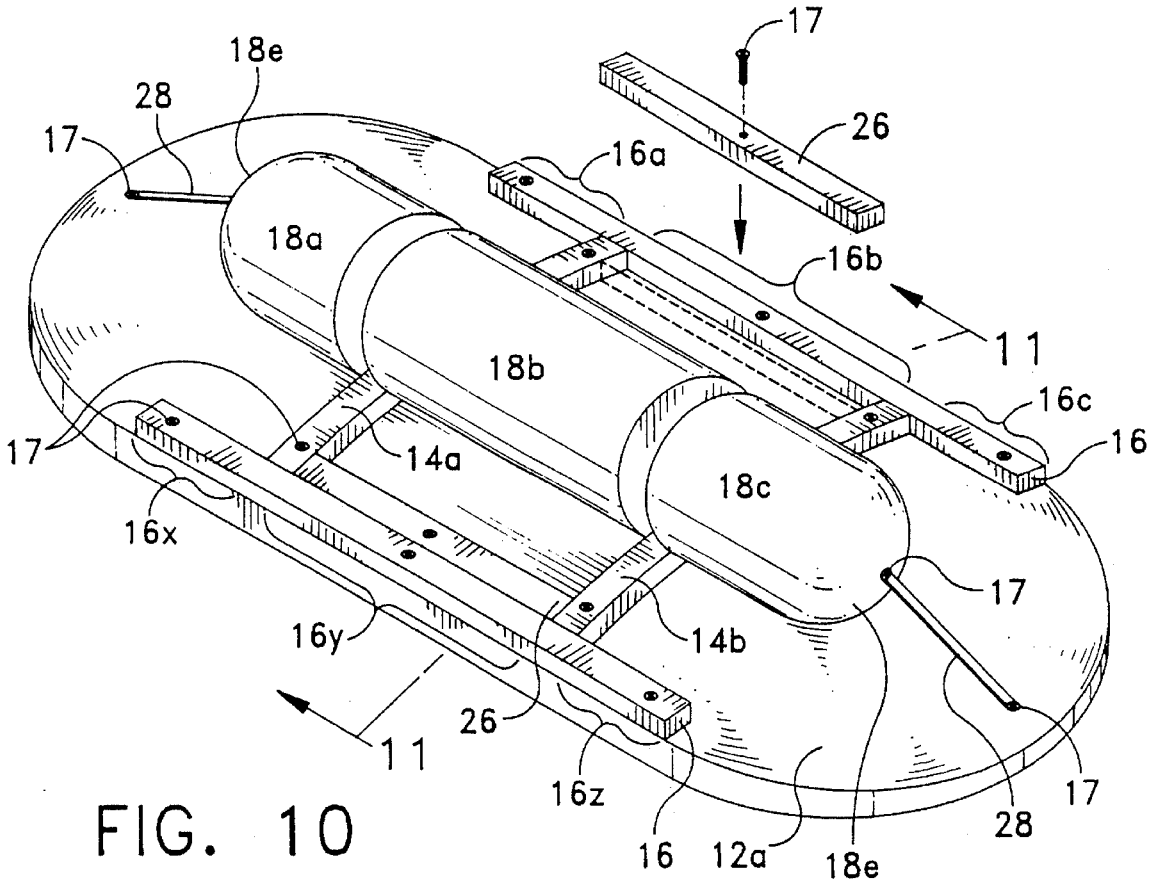
FIG. 10 is a perspective view of the present invention resting on its upper surface with additional optional features.
Figure 11:
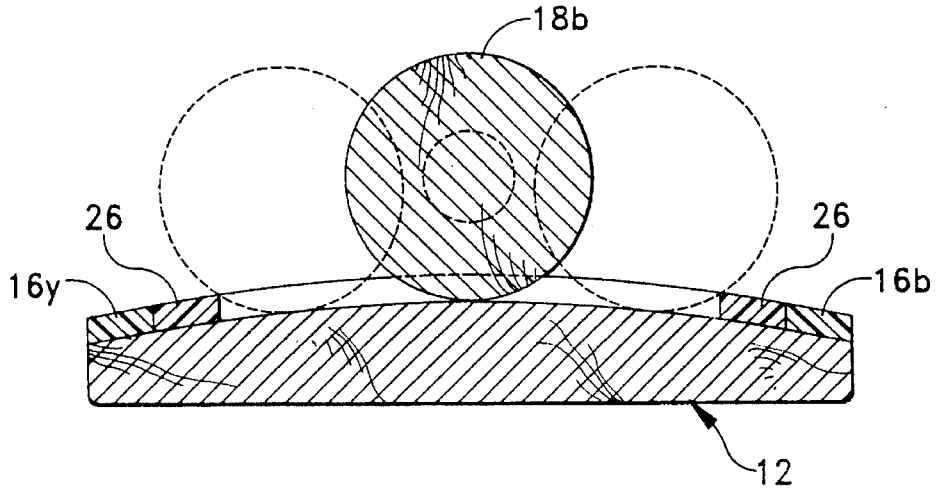
FIG. 11 is a cross sectional view through the line 11—11 of FIG. 10 illustrating a reduced range of movement of the cylindrical roller.

FIG. 10 illustrates a perspective view of the present invention with additional optional features. Supplementary stops 26 are provided on lower surface 12*a* in a position adjacent to stops 16L and 16R. As seen in FIG. 11, supplementary stops 26, which are positioned adjacent to central stop portions 16*y* and 16*b* to effectively further limit the rolling travel of roller member 18 on lower surface 12*a*. The supplementary stops 26 may also be secured to lower surface 12*a* by fasteners 17. In addition, elastic retaining straps 28 are connected from lower member ends 18*e* to proximal regions on lower surface 12*a*, respectively. As a result, roller member 18 is held in place and in close proximity to lower surface 12*a*. Since members 28 are elastic, the rolling travel of roller member 18 is unimpeded. In addition, elastic retaining straps 28 assist in biasing roller member 18 toward the middle of the width of board member 12.

Figure 12:
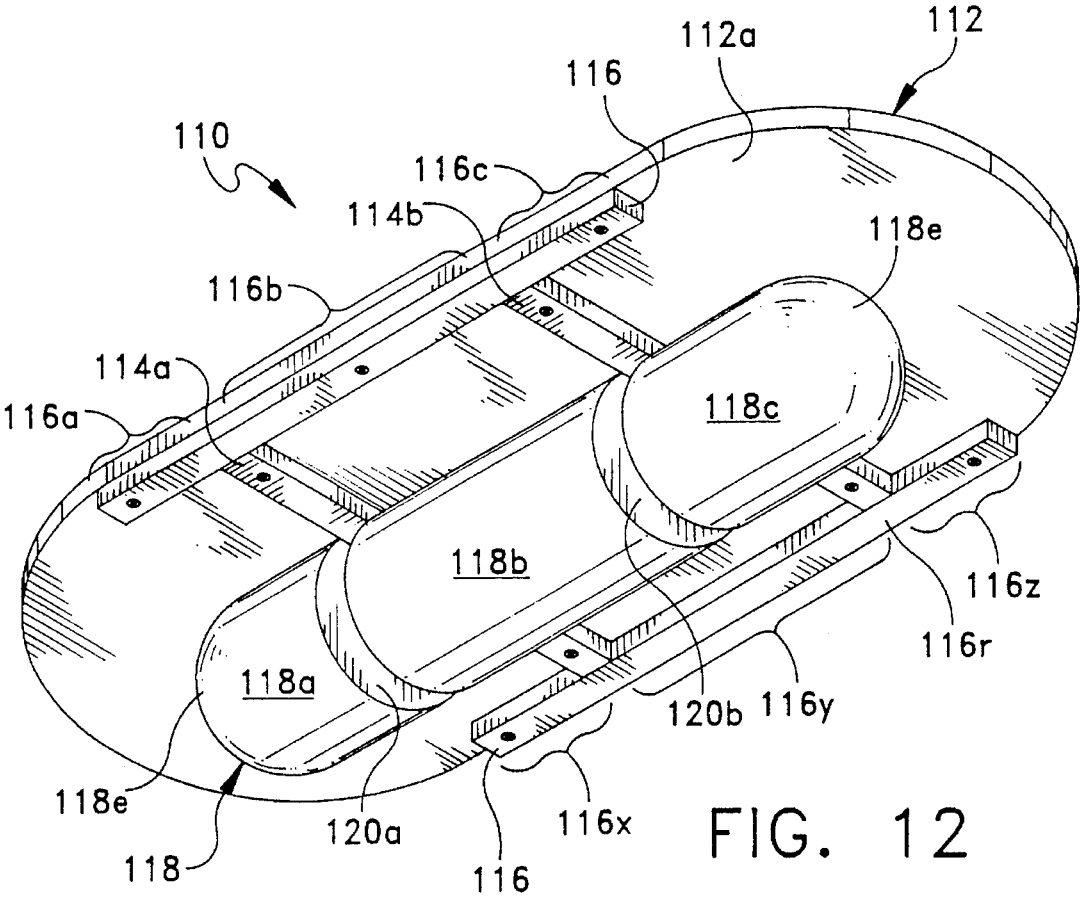
FIG. 12 is a perspective view from below of an alternative embodiment of the present invention.
Figure 13:
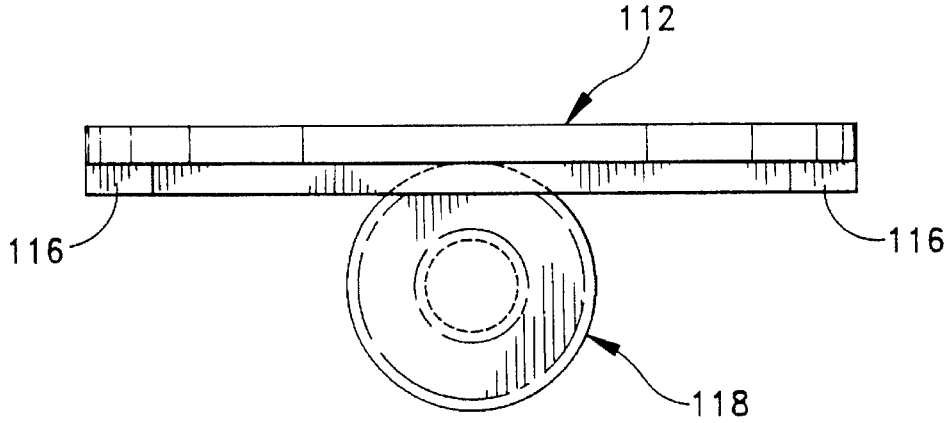
FIG. 13 is an end view of the alternative embodiment of FIG. 12.

FIGS. 12 and 13 illustrate an alternative embodiment of the present invention. In particular, board member 112 is flat with stop members 116L and 116R affixed thereto. In addition, cross-rails 114*a* and 114*b* are similarly positioned perpendicularly to stop members 116L and 116R. Guide slots 120*a* and 120*b* engage cross-rails 114*a* and 114*b*. The employment of the board member 112, which is flat, enables the user to more easily balance him or herself. This is in contrast to the curved or convex lower surface 12*a*, as seen in FIG. 1, where roller member 18 tends to travel toward one of the stop members 16L or 16R. FIG. 13 shows an end view of the alternative embodiment of the present invention as illustrated in FIG. 12.

It would be appreciated by those skilled in the art that various changes and modifications can be made to the illustrated embodiments without departing from the spirit of the present invention. All such modifications and changes are intended to be covered by the appended claims.

What is claimed is:

1. A snowboard simulator balancing board apparatus, comprising:

an elongate board member having an upper surface adapted to allow a user to stand thereon, a lower surface and two longitudinal edges, said elongate board member having a length substantially greater that its width;

a pair of stop members located on the lower surface of said elongate board member, said stop members being positioned proximal to and running along said longitudinal edges, respectively; and being substantially parallel to one another;

a pair of cross-rails located on the lower surface of said elongate board member, said cross-rails being positioned between and perpendicular to said stop members;

a cylindrical roller positioned on the lower surface of said elongate board member with its central axis being parallel to the length of the elongate board member; said cylindrical roller having a pair of spaced apart guide slots engageable with said cross-rails; said guide slots being spaced apart from one another to divide said cylindrical roller into a central roller region, a first extension roller region and a second extension roller region; said cross-rails being positioned relative to said stop members to divide said each stop member into a central stop portion, a first extension stop portion and a second extension stop portion; movement of said central roller region being limited by said central stop portion of each stop member; movement of said first extension roller region being limited by said first extension stop portion of each stop member; and movement of said second extension roller region being limited by said second extension stop portion of each stop member; said cylindrical roller including a first opposing end proximal to a first cross-rail and a corresponding first guide slot and a second opposing end proximal to a second cross-rail and a corresponding second guide slot; said first opposing end and said opposing end of said cylindrical roller being closed and of a convex shape; said first opposing end providing a first pivot surface and said second opposing end providing a second pivot surface;

said cylindrical roller being capable of lateral movement on said lower surface of said elongate board member in a direction perpendicular to the length of said elongate board member to closely simulate actual snowboard movement;

wherein said lower surface of said elongate board member is convex, running between said longitudinal edges, to thereby urge said roller toward one of said stop members when a user exerts a downward force to said upper surface of said elongate board member.

* * * * *